United States Patent [19]

Lenten

[11] Patent Number: 4,578,038

[45] Date of Patent: Mar. 25, 1986

[54] ELONGATED PROPELLING MEANS FOR MANUALLY MOVING A SAILING CRAFT OVER THE WATER SURFACE

[76] Inventor: Hendrik Lenten, Zijlroede 20, 8604 BB Sneek, Netherlands

[21] Appl. No.: 745,373

[22] Filed: Jun. 17, 1985

Related U.S. Application Data

[63] Continuation of Ser. No. 507,011, Jun. 23, 1983, abandoned.

[30] Foreign Application Priority Data

Aug. 3, 1982 [NL] Netherlands ..... 8203091
Aug. 18, 1982 [NL] Netherlands ..... 8203246

[51] Int. Cl.[4] ..... B63H 1/32

[52] U.S. Cl. ..... 440/19; 440/13; 440/101

[58] Field of Search ..... 440/13, 17–19, 440/24, 25, 32, 101; 416/64–68

[56] References Cited

U.S. PATENT DOCUMENTS 1,324,397 12/1919 Hobart ..... 440/17
2,733,680 2/1956 Wagner ..... 440/18
2,808,802 10/1957 Graham ..... 440/19
3,800,734 4/1974 Whang ..... 440/13
3,913,516 10/1975 Garcia ..... 440/19
4,302,194 11/1981 Perales ..... 440/13

*Primary Examiner*—Galen L. Barefoot
*Assistant Examiner*—C. T. Bartz
*Attorney, Agent, or Firm*—Kenyon & Kenyon

[57] ABSTRACT

A thrust device for manually advancing a water craft over a water surface includes a stick-like grip forming part of a stick carrying a thrust apparatus made of a flexible, substantially circular foil provided with radial stiffening members attached at equally spaced intervals along its circumference. A concentric stub-like tubular opening connects the foil to the stick near one end of the stick to be inserted in the water, and flexible tension members connecting the circumference of the foil to the one end of the stick define a maximum angle between the foil face and the stick when the one end of the stick is thrust into the water. Each tension member has one end attached to the edge of the circular foil and a second end. The second ends of all the tension members are led through a central hole in a cover slipped over the end of the stick and are joined into a junction larger than the hole in the cover.

6 Claims, 9 Drawing Figures

Fig. 1.
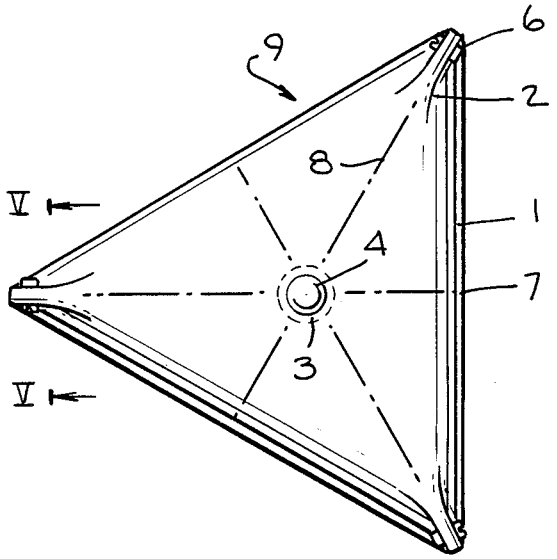
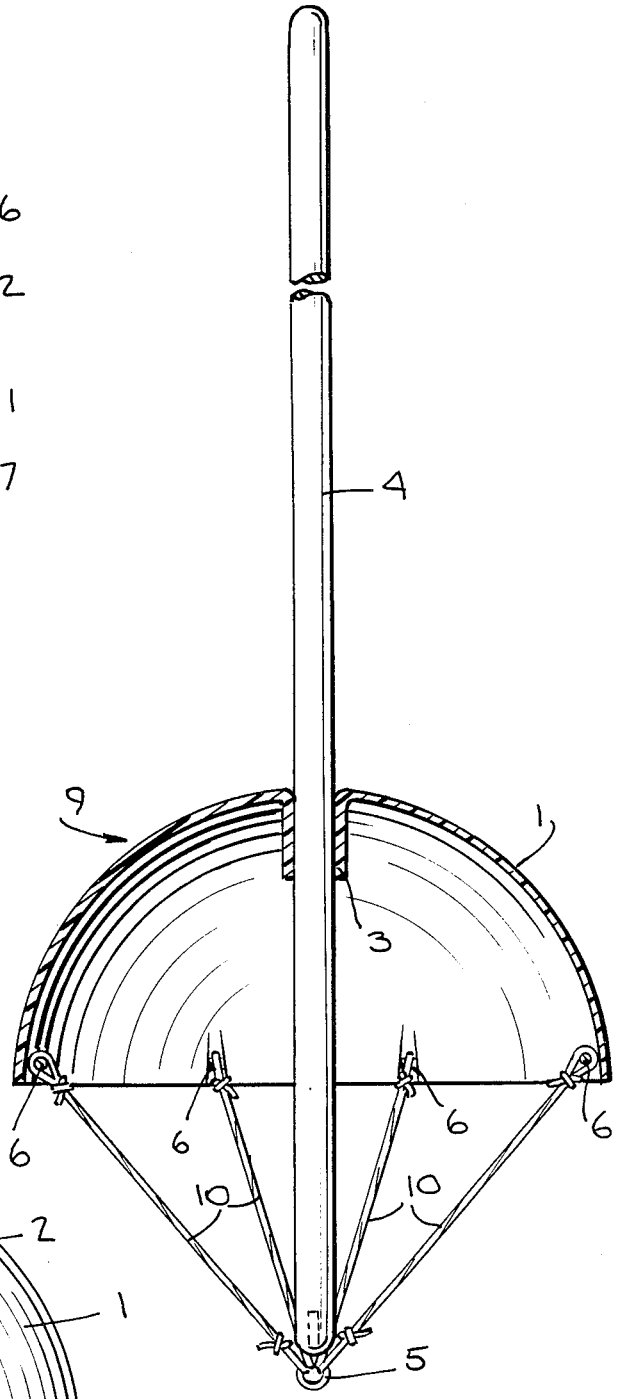
Fig. 4.
Fig. 2.
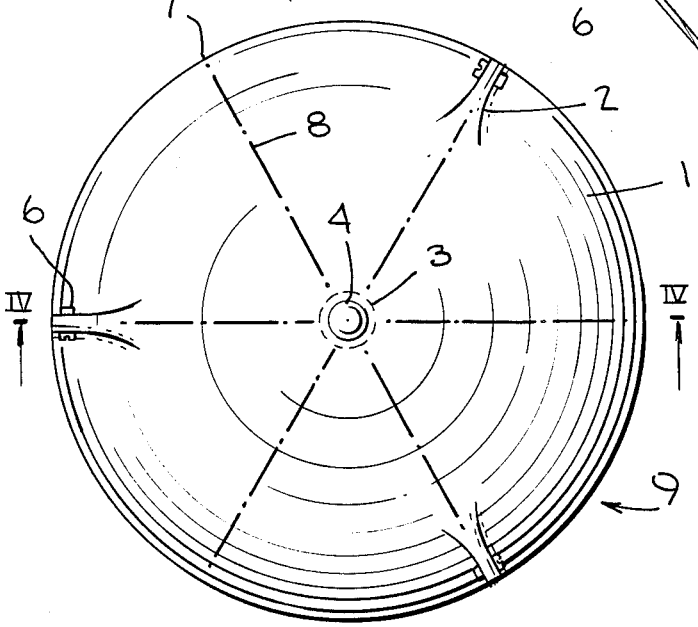

ELONGATED PROPELLING MEANS FOR MANUALLY MOVING A SAILING CRAFT OVER THE WATER SURFACE

This application is a continuation of application Ser. No. 507,011, filed June 23, 1983, now abandoned.

BACKGROUND OF THE INVENTION

1. Technical Field

The invention relates to a thrust device for manually propelling a craft over the water surface, said device being provided with a stick-like grip and with means attached to one end of the stick by which a thrust can be exerted on the water.

2. Background Information

Such a propelling means is known from Dutch application No. 8004444 and can be defined as a stick provided with opposable thrust faces.

SUMMARY OF THE INVENTION

It is an object of the invention to provide a propelling means of an improved construction presenting an enlarged thrust surface during the thrust stroke and a reduced surface during the withdrawal stroke so that the resistance encountered during withdrawal is reduced.

To this effect the invention provides an elongated propelling means of the above-described type, characterized by a stick or pole member carrying the thrust means, which thrust means includes a flexible, substantially circuler foil or web provided with radial stiffening members. In its center, the circular foil is fitted with a concentric stub-like tubular opening and is connected via said stub-like opening, either permanently or deteachably, to the stick, while the foil furthermore is provided between its circumference and the end of the stick to be inserted in the water with flexible tension members connecting the circumference of the foil to the one end of the stick for defining a maximum opening angle between the foil face and the stick.

The foil of the thrust means of a propelling member according to the invention is preferably made of soft polyvinyl chloride material, while the radial stiffening members serve to increase the stiffness, to facilitate collapse of the foil during retraction of the member from the water and to realize a substantial pre-tension in the released codition.

According to a preferred embodiment of the invention, the flexible tension members are formed of strings, cords, thin strips or lamellae, each of which has one end attached to the circumference of the foil and a second end attached to the lower part of the stick.

The second ends of the tension members, such as strings, may be connected to an eye screw in the head of the stick. In this manner there is produced an umbrella-like construction. During the retraction stroke folding of the foil occurs, and only little water need be displaced, so that the retraction of the member from the water takes place practically without resistance.

With three equally spaced stiffening members, the outer edge of the foil associated with the thrust means tends to assume in the released condition the form of an equilateral triangle. During the thrust stroke in the water, however, the foil circumference more or less assumes the circular form, while during retraction from the water, the outer edge of the foil assumes a star shape. Both the triangular and the star-shape are caused by the three radial stiffening members which, e.g., may have the form of folds applied in the foil.

The tube stub by which the foil is connected to the stick may be a separate member which is inserted through a center opening in the circular foil and is fixedly connected to the foil around its circumference, while the stick is fittingly inserted through the tube stub, said stub being clamped around the stick. Another possibility is one in which the tube stub is integral with the foil, formed by inserting the stick through an opening in the foil smaller in diameter than the outer diameter of the stick.

The foil associated with the thrust means may be an assembly of two superposed foil layers provided with radial stiffening members. The foils may be joined to each other, leaving non-joined interspaces between the foils according to a given pattern, which interspaces can be inflated to create the stiffening members.

An advantageous method of attachment of the tension members, e.g., the strings, to the head of the stick is to provide a tubular cavity in the one end of the stick to be inserted in the water. A sealing cap is fittingly inserted into the tubular cavity to prevent water from penetrating further into the tubualr cavity, and a cover is fittingly pushed over the tubular end all around, the wall of said cover containing a central opening through which the the second ends of the tension members having first ends connected to the foil circumference are conducted and are secured in the chamber by a common junction. Preferably the flexible tension members are strings made of a thermoplastic synthetic material, which strings are fused together into a ball larger than the central opening through the cover into the chamber.

The advantages of the above attachment method of the tension members are that the strings cannot get entangled, while the common junction can be made in a simple manner.

When the foil is made from a plastics material, it is possible during storage for the foil to assume an asymmetric form due to the properties of the plastics material, so that the propelling effectiveness is reduced in many cases. To avoid this, the foil can be furled and secured by a band. When the propelling member is used again, the outer edge of the foil no longer has a pure triangular shape in the released condition, but a more or less helical shape, while during retraction through the water a star shape with curved points is produced.

The opening of the thrust member at the beginning of the thrust stroke, after a period of storage with the band applied, takes place more uniformly and quickly. The band either may be endless or may have a knot or clasp connection. Although the material of the band is not critical, a substance having a large coefficient of friction relative to the substance from which the foil is made is preferred, since in that case the band remains in the proper position even with only a slight clamping stress.

The invention is particularly suitable for propelling buoyant water skis, offering as substantial advantages large thrust accompanied by substantially resistance-free retraction of the pusher sticks.

BRIEF DESCRIPTION OF THE DRAWINGS

The invention will now be described, by way of examples, with reference to the accompanying drawings, in which:

FIG. 1 is a top view, taken from the hand grip end of a propelling member, with the foil in the released condition;

FIG. 2 is a top view of the propelling member of FIG. 1 showing the foil shape in the thrust stroke condition;

FIG. 4 is a cross section of the propelling member along line IV—IV of FIG. 2;

DESCRIPTION OF THE PREFERRED EMBODIMENTS

Figure 3:
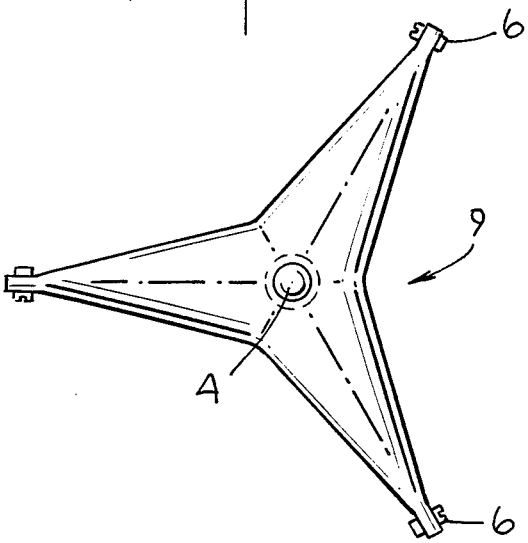
FIG. 3 is a top view of the propelling member of FIG. 1 showing the foil shape during the retraction stroke in the water.

A propelling member 9 (FIGS. 1–5) consists of thrust means comprising a thin circular foil 1 provided with three folds 2. The foil 1 is provided in the center with a tubular opening 3 by means of which foil 1 is clamped or screwed onto a stick or pole member 4.

A screw eye 5 is attached to the lower end of the stick 4. Strings 10 are stretched between the screw eye 5 and attachment points 6 and 7 disposed alternately along the circumference of the foil, said strings determining the enclosed angle of the thrust member in its loaded condition. The attachment points 6 also serve to apply the folds 2.

Figure 6:
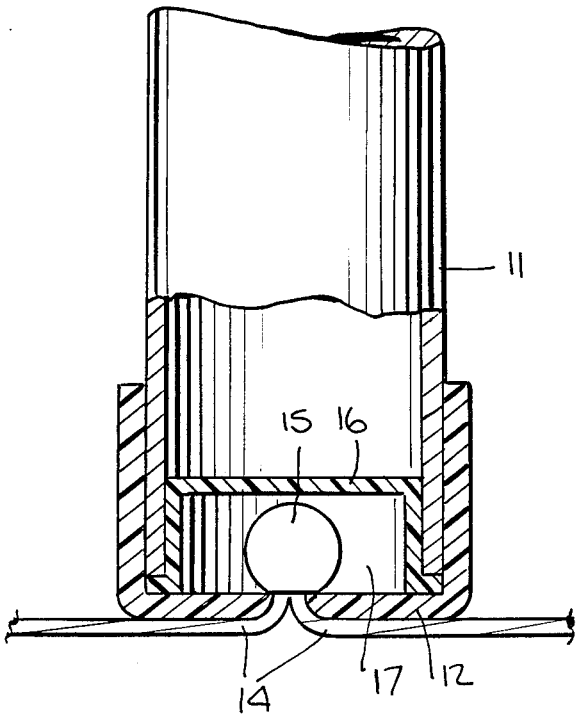
FIG. 6 is an axial cross section of one end of an embodiment of a pole member according to the invention, the one end being intended to be inserted in the water.
Figure 7:
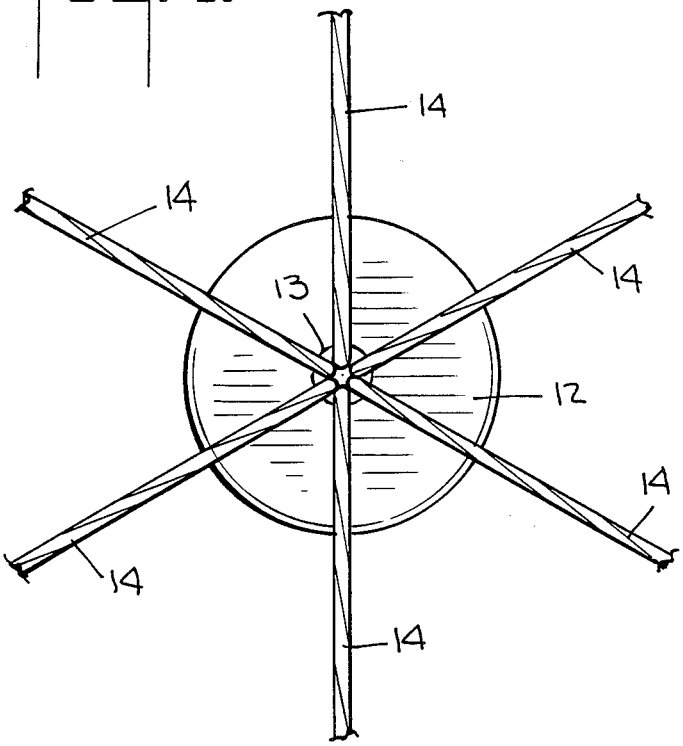
FIG. 7 is an end view of the embodiment of FIG. 6.
Figure 5:
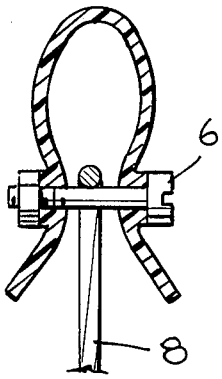
FIG. 5 is a cross section along V—V of FIG. 1.

An alternative attachment arrangement for the strings at the lower end of the stick 11 of the propelling member according to the invention is shown in FIGS. 6 and 7. This alternative arrangment comprises a cover 12 having a central hole 13 through which strings 14 are inserted. At the inner side of the cover 12 the strings are joined by a junction 15 by means of which the strings are secured to the stick and entanglement of the strings is avoided. A sealing cup 16 prevents the penetration of water into the interior of the stick 11. The cover 12 in conjunction with the sealing cup 16 constitutes a chamber 17.

Figure 8:
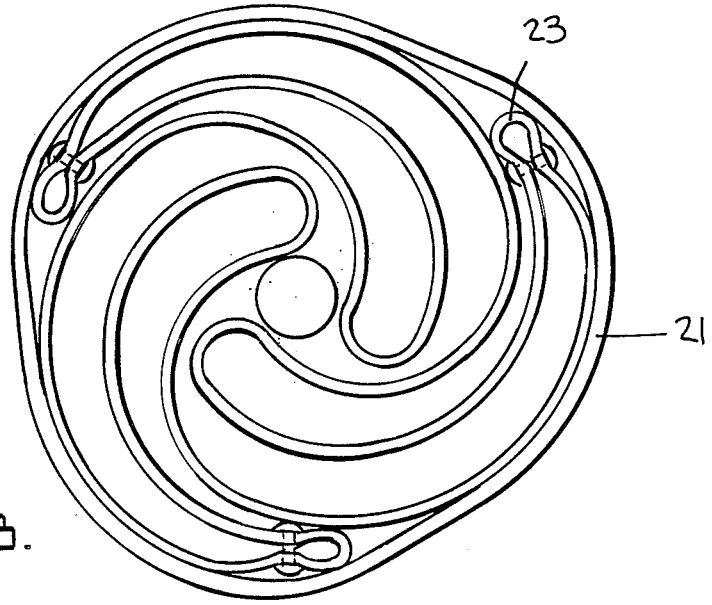
FIG. 8 is an end view of the end to be inserted in the water of a different embodiment of the propelling member according to the invention.
Figure 9:
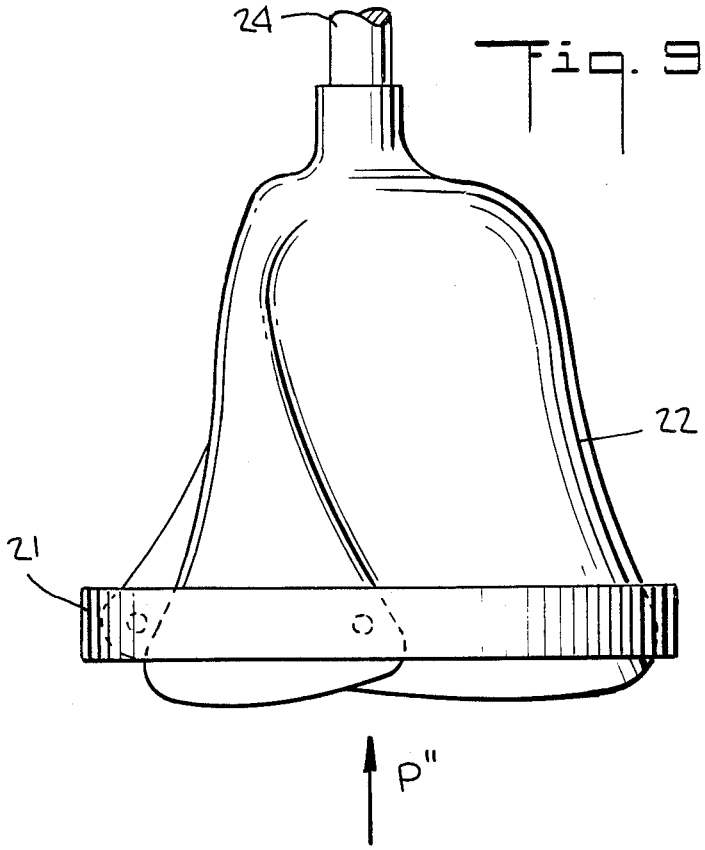
FIG. 9 is a side view of the embodiment of FIG. 8.

A band 21 (FIGS. 8 and 9) can be applied around the bottom end of a foil 22 after the foil has been furled about the stick 24.

Naturally, modifications may be made in the propelling member according to the invention, as discussed in the above and as shown in the drawings, without departing from the scope of the invention.

What I claim is:

1. A thrust device for manually propelling a water craft over the surface of the water, the thrust device including an elongated pole member and thrust means disposed adjacent to one end of the pole member, the thrust means comprising:

a flexible substantially circular foil;

a tubular collar formed at the center of the substantially circular foil, the collar being fastened to the pole member at a location adjacent to but spaced from said one end of the pole member;

a plurality of elongated flexible tension members, each tension member having a first end and a second end;

means for attaching the first ends of the tension members at spaced apart locations around the circumference of the substantially circular foil; and means for attaching the second ends of the tension members to said one end of the pole member, the lengths of the tension members being selected to hold the substantially circular foil open at a predetermined apex angle between the pole member and the foil, wherein:

the foil is made of soft plastics material and is provided with three equally spaced folds formed at the periphery of the foil and extending toward the center thereof, the plurality of tension members consist of six flexible lines attached to six locations equally spaced around the periphery of the foil, and alternate ones of the means for attaching the first ends of the tension members to the circumference of the foil are means for applying said folds to the foil; and wherein when the device is in the stored condition the folds are wrapped around the pole in a spiral direction, and the device further comprises an annular band surrounding the foil when the device is in the stored condition so as to set a spiral curve in the folds of the plastic foil to facilitate opening of the foil during a thrust stroke of the pole into the water and to facilitate collapse of the foil during a retraction stroke of the pole from the water.

2. A thrust device according to claim 1 wherein the one end of the pole member is formed with an open central cavity, and the means for attaching the second ends of the tension members to the pole member comprises a cover fitting over the open end of the pole member, the cover having a central opening communicating with said central cavity, and the second ends of the flexible tension members being led through said central opening and being mutually joined inside the cavity, the junction of the second ends being larger than said central opening to prevent the second ends from being pulled out of said cavity.

3. A thrust device according to claim 2, wherein the one end of the pole member is formed as a tubular end, and the device further comprises a sealing cup inserted into the tubular end to prevent water from leaking into the tubular end of the pole member.

4. A thrust device according to claim 1, wherein said tubular collar comprises a separate member which is inserted into an opening in the center of the flexible foil and the periphery of which is secured to the foil, the pole member being inserted through the tubular collar, and the device further comprises means for clamping the tubular collar to the pole member.

5. A thrust device according to claim 1, wherein the tubular collar is formed integrally with the flexible foil by upsetting part of the foil upon insertion of the pole member through a center opening in the foil that is smaller than the outer diameter of the pole member.

6. A thrust device according to claim 1, wherein the flexible tension members are made of a thermoplastic synthetic material, the second ends of said members being fused into a ball to form said junction.

* * * * *